US009725142B2

(12) United States Patent
Glass

(10) Patent No.: US 9,725,142 B2
(45) Date of Patent: Aug. 8, 2017

(54) SUPPLEMENTAL BUMPER APPARATUS ATTACHABLE TO A WATER CRAFT

(71) Applicant: Shepheard William Glass, Modesto, CA (US)

(72) Inventor: Shepheard William Glass, Modesto, CA (US)

( * ) Notice: Subject to any disclaimer, the term of this patent is extended or adjusted under 35 U.S.C. 154(b) by 0 days.

(21) Appl. No.: 15/136,296

(22) Filed: Apr. 22, 2016

(65) Prior Publication Data

US 2016/0236759 A1 Aug. 18, 2016

Related U.S. Application Data

(63) Continuation-in-part of application No. 14/243,680, filed on Apr. 2, 2014, now abandoned.

(51) Int. Cl.
*B63B 59/02* (2006.01)
*B63B 35/73* (2006.01)

(52) U.S. Cl.
CPC ..... *B63B 59/02* (2013.01); *B63B 35/731* (2013.01)

(58) Field of Classification Search
CPC ..... B63B 59/00; B63B 59/02; B63B 35/73; B63B 35/731; B63B 2059/00; B63B 2059/02; B63B 2035/73
USPC ..... 114/219, 343, 361, 364
See application file for complete search history.

(56) References Cited

U.S. PATENT DOCUMENTS 4,970,980 A 11/1990 Eisner
5,560,312 A 10/1996 McPherson
5,762,019 A 6/1998 O'Rourke et al.
6,021,729 A 2/2000 DeRuscio
6,477,973 B1 * 11/2002 Kobas ..... B63B 59/02 114/219
6,848,383 B2 2/2005 Maeda et al.
6,863,011 B2 * 3/2005 Kinkead ..... B63B 59/02 114/219
6,983,711 B1 1/2006 Lemke
7,293,518 B1 * 11/2007 Gassew ..... A01K 97/10 114/219
D557,652 S * 12/2007 Gassew ..... D12/317
7,509,920 B2 3/2009 Taylor
7,918,176 B2 4/2011 Simard et al.
8,029,209 B2 10/2011 Aschenbach
9,365,268 B1 * 6/2016 Paccoud ..... B63B 59/02
2010/0077953 A1 4/2010 Simard et al.

* cited by examiner

*Primary Examiner* — Daniel V Venne

(74) *Attorney, Agent, or Firm* — The Keys Law Firm PLLC

(57) ABSTRACT

A supplemental bumper apparatus for covering the bumper of a personal water craft and providing enhanced shock absorption and blemish resistance. The supplemental bumper apparatus comprises a synthetic rubber body and a fastener system. The synthetic rubber body provides a barrier which can absorb shock and block blemishes from an impact. The synthetic rubber body is attached to the bumper fastener system defined by a plurality of snap fasteners on its upper section and a hook and loop fabric fastener is on its lower section. A plurality of snap fastener base members are permanently attached to the bumper and a corresponding hook and loop fastener material is permanently attached to the bumper, each providing a corresponding engaging member to enable the snap fasteners and the hook and loop fastener surface to attach the synthetic rubber body to the surface of the bumper.

10 Claims, 4 Drawing Sheets

SUPPLEMENTAL BUMPER APPARATUS ATTACHABLE TO A WATER CRAFT

CROSS REFERENCE TO RELATED APPLICATIONS

This application is a continuation in part of, claims the benefit of, and incorporates by reference co-pending U.S. patent application Ser. No. 14/243,680, filed Apr. 2, 2014.

BACKGROUND OF THE INVENTION

Field of the Invention

This invention relates generally to watercraft accessories and, more particularly, to a supplemental for enhancing the reduction in damage to a watercraft during a collision.

Description of the Prior Art

The use of personal water craft devices, such as a Sea-Doo, Jet Ski, and WaveRunner for on waterways around the world is well known. Personal water craft devices are typically designed for a standing, on-board operator, and potentially one to two additional passengers to be transported. In use, personal water craft are often operated by tourists and other novice/inexperienced operators, and usually in high traffic areas. As such, collisions between personal watercraft and other objects, including other personal watercraft, are relatively common.

While the existing bumpers on personal water craft are often suitable to reduce the chance of structural damage in the event of minor collisions, superficial and minor damage still commonly occurs in the event of such collisions. Thus, there remains a need for a supplemental bumper apparatus which could be attached to the existing bumper of a personal water craft would reduce damage to the bumper of a watercraft in the event of a collision. It would be helpful if such a supplemental bumper apparatus could be removably attached to a personal watercraft after market. It would be additionally desirable for such a supplemental bumper apparatus to employ a dual fastener system to ensure it does not inadvertently fall off.

The Applicant's invention described herein provides for a supplemental bumper apparatus adapted to be attached to the bumper area of a personal water craft and improve shock absorbing capability. The primary components in Applicant's supplemental bumper apparatus are a bumper panel having synthetic rubber body and a fastener system. When in operation, the supplemental bumper apparatus reduces the damage to a personal water craft in the event of a collision. As a result, many of the limitations imposed by prior art structures are removed.

SUMMARY OF THE INVENTION

A supplemental bumper apparatus for covering the bumper of a personal water craft and providing enhanced shock absorption and blemish resistance. The supplemental bumper apparatus comprises a synthetic rubber body and a fastener system. The synthetic rubber body provides a reduction in how much shock is received and thus absorbed by the bumper of the personal water craft. This reduction in shock results in less damage to the bumper and the personal water craft in the event of a collision. In addition, the synthetic rubber body provides a barrier which can receive scratches and other blemishes from an impact in lieu of the bumper.

In a planar embodiment, the synthetic rubber body is attached to the bumper through a fastener system which is defined by a plurality of snap fasteners on its upper section and a hook and loop fabric fastener is on its lower section. A plurality of snap fastener base members are permanently attached to the bumper and a corresponding hook and loop fastener material is permanently attached to the bumper, each providing a corresponding engaging member to enable the snap fasteners and the hook and loop fastener surface to attach the synthetic rubber body to the surface of the bumper.

In an arcuate embodiment, the synthetic rubber body defines an arcuate member and is attached to the bumper through a fastener system defined by a plurality of top fasteners and a plurality of bottom fasteners. The synthetic rubber body is secured to a target bumper with the top fasteners engaging a top side of the synthetic rubber body and the target bumper at an angle and the bottom fasteners engage the bottom side of the the target bumper.

It is an object of this invention to provide a supplemental bumper apparatus which could be attached to the existing bumper of a personal water craft would reduce damage to the bumper of a watercraft in the event of a collision.

It is another object of this invention to provide a supplemental bumper apparatus capable of being removably attached to a personal watercraft after market.

It is yet another object of this invention to provide a supplemental bumper apparatus which employs a dual fastener system to ensure it does not inadvertently fall off.

These and other objects will be apparent to one of skill in the art.

DETAILED DESCRIPTION OF THE INVENTION

Figure 1:
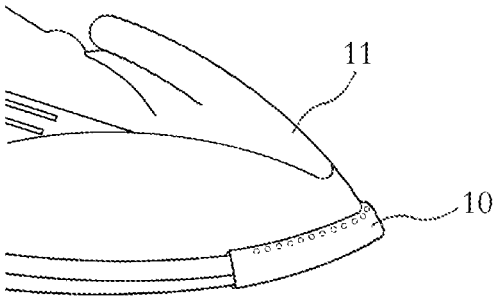
FIG. 1 is a partial side elevational view of a supplemental bumper apparatus built in accordance with a planar embodiment of the present invention shown attached to a personal water craft.
Figure 2:
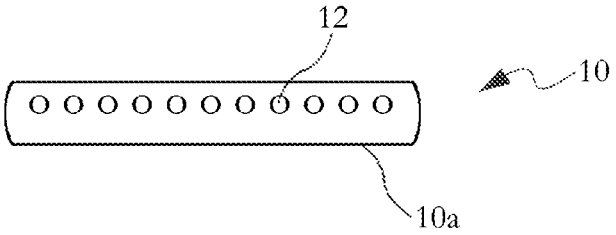
FIG. 2 is a front elevational view of a supplemental bumper apparatus built in accordance with a planar embodiment of the present invention.
Figure 3:
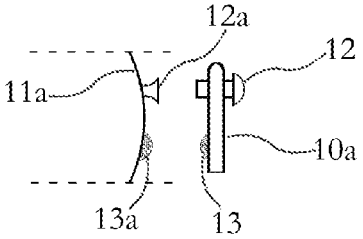
FIG. 3 is a partial side elevational view of a supplemental bumper apparatus built in accordance with a planar embodiment of the present invention with a snap fastener in shadow.

Referring now to the drawings and in particular FIGS. 1, 2, and 3, a supplemental bumper apparatus 10 built in accordance with a planar embodiment is sized to be placed over the bumper 11*a* of a personal water craft 11. The supplemental bumper apparatus 10 is defined by a synthetic rubber body 10*a* and a fastener system. In the preferred embodiment, the synthetic rubber body 10*a* is constructed of an ethylene propylene diene monomer ("EPDM rubber") and the fastener system includes a plurality of snap fasteners 12 and a hook and loop fabric fastener surface 13. Due to its construction of EPDM rubber and its placement directly over the bumper 11*a*, the synthetic rubber body 10*a* provides a reduction in how much shock is received and thus absorbed by the bumper 11*a* of the personal water craft 11. This reduction in shock results in less damage to the bumper 11*a* and the personal water craft 11 in the event of a collision. In addition, the synthetic rubber body 10*a* provides a barrier which can receive scratches and other blemishes from an impact in lieu of the bumper 11*a*. As such, the bumper 11*a* can remain relatively blemish free. Such a reduction in damage and blemishes enables the bumper 11*a* to have a longer effective life while on the personal water craft 11.

The synthetic rubber body 10*a* is attached to the bumper 11*a* fastener system defined by two discrete fastener systems. A plurality of snap fasteners 12 are employed on the upper section of the synthetic rubber body 10*a*. A hook and loop fabric fastener 13 is employed on the lower section of the synthetic rubber body 10*a*. Before the synthetic rubber body 10*a* can be attached to the bumper 11*a*, a plurality of snap fastener base members 12*a* are permanently attached to the bumper 11*a*, oriented in a corresponding manner relative to the snap fasteners 12 on the synthetic rubber body 10*a*. In addition, a corresponding hook and loop fastener material 13*a* is permanently attached to the bumper 11*a*, oriented below the snap fastener base members 12*a* such that when the snap fasteners 12 of the synthetic rubber body 10*a* are engaged to the snap fastener base members 12*a*, the hook and loop fastener surface 13 will engage the corresponding hook and loop fastener material 13*a*. By the engaging of the snap fasteners 12 with the snap fastener base members 12*a* and the hook and loop fastener surface 13 with the hook and loop fastener material 13*a*, the synthetic rubber body 10*a* is attached to the surface of the bumper 11*a*.

It is contemplated that the synthetic rubber body 10*a* is sized in the preferred embodiment to directly correspond to the size of the bumper 11*a* so as to enable the base body to cover the bumper without encroaching over the remainder of the personal water craft and affecting the aerodynamics of the body of the personal water craft.

Figure 4:
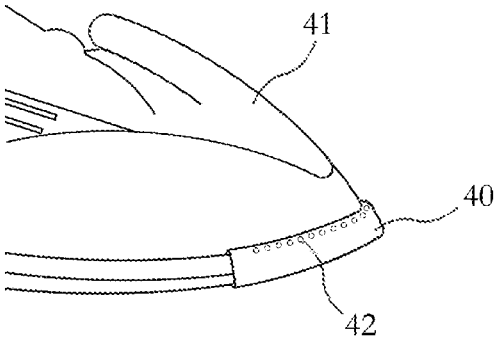
FIG. 4 is a side elevational view of a supplemental bumper apparatus built in accordance with an alternate implementation of the planar embodiment of the present invention permanently shown attached to a personal water craft.
Figure 5:
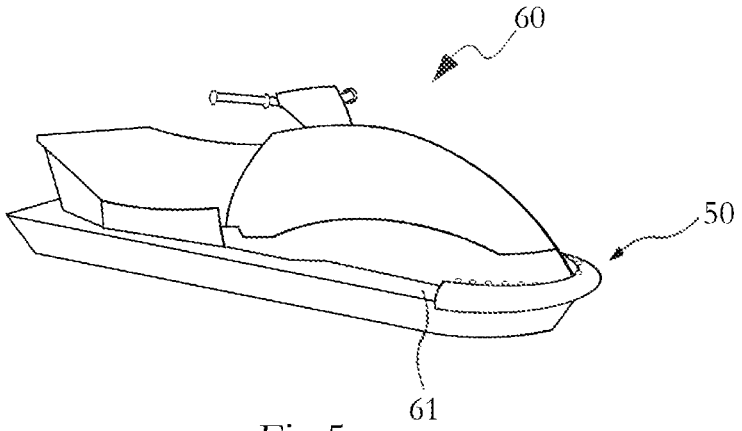
FIG. 5 is a side perspective view of a supplemental bumper apparatus built in accordance with an arcuate embodiment of the present invention shown attached to a personal water craft.
Figure 6:
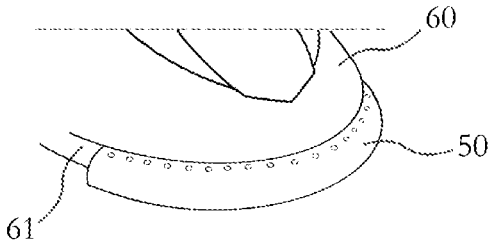
FIG. 6 is a partial front perspective view of a supplemental bumper apparatus built in accordance with an arcuate embodiment of the present invention shown attached to a personal water craft.
Figure 7:
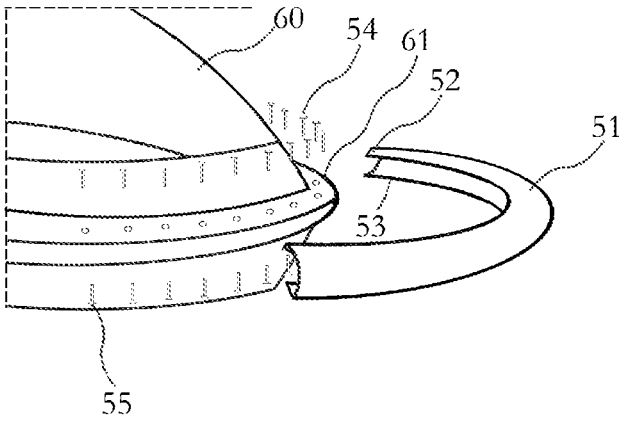
FIG. 7 is a partial exploded side perspective view of a supplemental bumper apparatus built in accordance with an arcuate embodiment of the present invention shown with a personal water craft.
Figure 8:
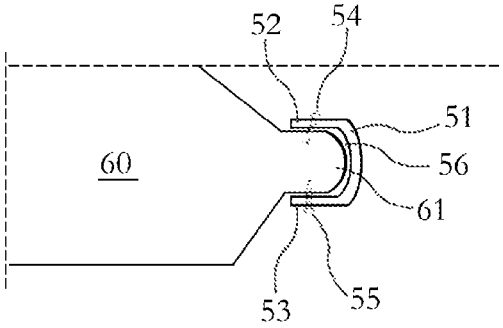
FIG. 8 is a partial side elevational view of a cross section of a supplemental bumper apparatus built in accordance with an arcuate embodiment of the present invention shown attached to a personal water craft.

Referring now to FIG. 4, in an alternate embodiment, the synthetic rubber body of a supplemental bumper apparatus 40 is permanently attached to the bumper 41 through a plurality of bolts 42 which penetrate the synthetic rubber body and the bumper 41.

Referring now to FIGS. 5, 6, 7, and 8, a supplemental bumper apparatus 50 built in accordance with an arcuate embodiment is sized to be placed over a protruding lip of a bumper 61 on a personal water craft 60. The supplemental bumper apparatus 50 is defined by a synthetic rubber body 51 and a dual fastener system. The synthetic rubber body 51 defines an arcuate member having a top side 52 and a bottom side 53. As with the planar embodiment, the synthetic rubber body 51 may be constructed of EPDM rubber.

The synthetic rubber body 51 is secured to the personal water craft 60 through a dual fastener system which includes a plurality of top fasteners 54 and a plurality of bottom fasteners 55. In one embodiment, the top fasteners 54 and bottom fasteners define elongated mechanical fasteners, such as bolts, nails or screws. The top fasteners 54 operate to secure the synthetic rubber body 51 to a target bumper 61 by engaging the top side 52 of the synthetic rubber body 51 and the target bumper 61 at an obtuse angle (referred to herein as a "fastening angle") relative to the top surface of the protruding lip of target bumper 61 and surface of the hull of the personal water craft 60. It is contemplated that by orienting the top fasteners 54 at the fastening angle, the synthetic rubber body 51 is less likely to sag (better able to resist gravitational force and impact from water than the fasteners being vertically engaging) or otherwise lose is positioning over the target bumper 61 over a time period of use. The bottom fasteners 55 operate to secure the synthetic rubber body 51 to a target bumper 61 by engaging the bottom side 53 of the synthetic rubber body 51 and the target bumper 61 at a right angle (referred to herein as a "vertically") relative to the bottom surface of the protruding lip of target bumper 61. It is contemplated that the bottom fasteners 55 are positioned vertically to ensure a tight, secure fit (noting that from this orientation gravitational forces would have less of an impact).

It is appreciated that in the arcuate embodiment, the synthetic rubber body 51 is positioned over the target bumper 61 such that an absorption space 56 (1½ inches to 2¼ inches in one embodiment) is left between the distal end of the lip of the bumper 61 (relative to the personal water craft 60) and the synthetic rubber body 51. This absorption space 56 increases the shock absorption capability of the supplemental bumper apparatus 50 beyond what is provided by the material of the synthetic rubber body 51.

In yet another embodiment, the synthetic rubber body of a supplemental bumper apparatus is permanently attached to the bumper through an adhesive.

In still another embodiment, the synthetic rubber body is sized to cover additional surface area exposed to collisions on the personal water craft beyond the bumper.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A supplemental bumper apparatus for covering the bumper of a personal water craft, comprising:

an arcuate base body having a top side and a bottom side and sized to correspond to the size of a protruding portion of a target bumper on a personal water craft, wherein when said arcuate base body is positioned against the target bumper, the arcuate base body is adapted to cover the protruding portion without encroaching over a portion of the personal water craft other than the protruding portion and while leaving an absorption space between the arcuate base body and target bumper;

a plurality of top fasteners each adapted to engage the top side and the target bumper at a fastening angle when said arcuate base body is positioned against the target bumper, thereby securing the arcuate base body to target bumper; and a plurality of bottom fasteners each adapted to engage the bottom side and the target bumper vertically when said arcuate base body is positioned against the target bumper, thereby securing the arcuate base body to target bumper.

2. The supplemental bumper apparatus of claim 1, wherein said arcuate base body is constructed of a synthetic rubber material.

3. The supplemental bumper apparatus of claim 2, wherein said arcuate base body is constructed of ethylene propylene diene monomer.

4. A supplemental bumper apparatus for covering the bumper of a personal water craft, comprising:

an arcuate base body having a top side and a bottom side and sized to correspond to the size of a protruding portion of a target bumper on a personal water craft, wherein when said arcuate base body is positioned against the target bumper, the arcuate base body is adapted to cover the protruding portion without encroaching over a portion of the personal water craft other than the protruding portion;

a plurality of top fasteners each adapted to engage the top side and the target bumper, thereby securing the arcuate base body to target bumper; and a plurality of bottom fasteners each adapted to engage the bottom side and the target bumper, thereby securing the arcuate base body to target bumper.

5. The supplemental bumper apparatus of claim 4, wherein when said arcuate base body is positioned against the target bumper, the arcuate base body is adapted to leave an absorption space between the arcuate base body and target bumper.

6. The supplemental bumper apparatus of claim 4, wherein the plurality of top fasteners are each adapted to engage the top side and the target bumper at a fastening angle when said arcuate base body is positioned against the target bumper.

7. The supplemental bumper apparatus of claim 4, wherein the plurality of bottom fasteners are each adapted to engage the bottom side and the target bumper vertically when said arcuate base body is positioned against the target bumper.

8. The supplemental bumper apparatus of claim 4, wherein said arcuate base body is constructed of a synthetic rubber material.

9. The supplemental bumper apparatus of claim 8, wherein said arcuate base body is constructed of ethylene propylene diene monomer.

10. A method of securing a supplemental bumper apparatus for covering the bumper of a personal water craft to a target bumper of a personal water craft, comprising the steps of:

positioning an arcuate base body having a top side and a bottom side and sized to correspond to the size of a protruding portion of the target bumper such that the arcuate base body covers the protruding portion without encroaching over a portion of the personal water craft other than the protruding portion and leaves an absorption space between the arcuate base body and target bumper;

inserting a plurality of top fasteners into the top side and the target bumper at a fastening angle, thereby securing the arcuate base body to target bumper; and inserting a plurality of bottom fasteners into the bottom side and the target bumper vertically, thereby securing the arcuate base body to target bumper.

* * * * *